United States Patent [19]

Brettrager

[11] 4,056,993

[45] Nov. 8, 1977

[54] SHEET SLITTER AND PUNCH ASSEMBLY

[76] Inventor: Henry J. Brettrager, 5450 East Street, Saginaw, Mich. 48601

[21] Appl. No.: 708,835

[22] Filed: July 26, 1976

[51] Int. Cl.[2] ..... B26D 9/00; B26D 11/00

[52] U.S. Cl. ..... 83/82; 83/110; 83/210; 83/255; 83/405; 83/408; 83/482

[58] Field of Search ..... 83/82, 81, 80, 110, 83/210, 209, 255, 405, 408, 482, 925 R

[56] References Cited

U.S. PATENT DOCUMENTS

| | | | |
|---|---|---|---|
| 1,130,909 | 3/1915 | Kremer | 83/482 |
| 3,301,114 | 1/1967 | Joa | 83/255 X |
| 3,458,381 | 7/1969 | Metcalfe | 83/408 X |
| 3,611,856 | 10/1971 | Adair | 83/408 X |
| 3,657,952 | 4/1972 | Brockbank | 83/408 X |
| 3,762,251 | 10/1973 | Madsen et al. | 83/925 R |
| 3,848,501 | 11/1974 | Kuts | 83/482 X |

*Primary Examiner*—J. M. Meister
*Attorney, Agent, or Firm*—Learman & McCulloch

[57] ABSTRACT

Sheet slitting and punching apparatus for cutting a large elongate sheet of paperboard or similar material into a plurality of rectangular cards of uniform size and punching holes in each of the individual cards. A large sheet is fed along a conveying means having two tandemly arranged feed sections separated from each other by a transverse and a longitudinal slitting station. Both feed sections of the conveyor are driven from a common drive means, however, the upstream or infeed section is driven at a conveying speed substantially slower than that of the downstream or outfeed section. Transversely spaced slitters form longitudinally extending slits in the sheet as it is fed along the conveying means. When the feeding end of the sheet reaches a predetermined location near the upstream end of the outfeed conveyor, it engages a sensing element which immediately stops the conveyor drive. While the conveyor drive is stopped, a transverse slitting member is driven transversely across the sheet from one side to the other and a punch assembly is actuated to punch holes in each of the cards so formed. At the conclusion of a transversely slitting and punching operation, the conveyor drive is restarted and that portion of the sheet downstream from the transverse cut is carried forwardly away from the advancing sheet by the higher speed of the outfeed conveyor section so that the newly formed leading end of the sheet can actuate the sensing means when it arrives at the predetermined location on the outfeed section.

2 Claims, 4 Drawing Figures

SHEET SLITTER AND PUNCH ASSEMBLY

SUMMARY OF THE INVENTION

The present invention is especially designed to cut and punch rectangular cards of a uniform size from a larger sheet. One example in which such apparatus is employed is the formation of blister package cards in which small articles are enclosed in a transparent plastic blister which is mounted to the surface of a larger card. In making up these blister packages, a relatively large number of individual articles are packaged within blisters at spaced locations upon a relatively large sheet which is then slit longitudinally and transversely to form individual cards each having a single article packaged on the card. In the usual case, the individual cards are provided with a punched opening so that the cards can be hung from a rod-like hanger in a sales display.

Apparatus embodying the present invention is especially designed to receive such a large sheet and to longitudinally and transversely slit the sheet to form the individual card packages in a manner such that the article containing blisters do not interfere with the slitting mechanisms.

In accordance with the present invention, a sheet to be cut and punched is placed upon a first belt conveyor and fed longitudinally in guided movement across the first conveyor and thence across first a flat plate or anvil extending transversely of the path of movement of the sheet beyond the downstream end of the first conveyor, and thence across the upper surface of a back-up roller against which a plurality of transversely spaced slitting wheels bear to slit the sheet in parallel longitudinal lines as the sheet is advanced across the back-up roller. Beyond the back-up roller, the longitudinally slit sections of the sheet pass onto the upstream end of an outfeed conveyor which is driven at a conveying speed substantially greater than that of the infeed conveyor. At a location near the upstream end of the outfeed conveyor, a limit switch is located to have its striker depressed by the leading end of the sheet. When limit switch striker is depressed, it conditions a control circuit to deenergize the drive motor for the two conveyors to halt movement of the sheet.

Above the anvil, a transversely extending support member supports a slitter wheel carriage for sliding movement transversely of the direction of feed of the sheet between opposite end limits located respectively beyond the opposite side edges of the sheet on the conveyor. The support member is mounted for vertical reciprocatory movement between an elevated position in which the transverse slitter wheel is clear of the sheet in a lower position in which the transverse slitter wheel, in cooperation with the anvil, can transversely slit the sheet as the wheel is moved from one end limit to the other. When the conveyor motor is deenergized, the slitter wheel is lowered and driven transversely across the sheet to transversely slit the sheet, thereby separating the leading end portion of the sheet, which is now in contact with the outfeed conveyor. After the transverse slitter wheel has been driven entirely across the sheet, it reaches its opposite end limit of movement, at which time the support member is raised. After the support member is raised clear of the sheet, the transverse slitter wheel is driven back to its original rest position. A series of punches carried on the support member punch holes in the sheet when the support member is lowered.

When the support member is restored to its elevated position, the control circuit is actuated to reenergize the conveyor drive motor. The severed leading end portion of the sheet, being in contact with the outfeed conveyor, is carried away by the outfeed conveyor at a speed faster than the remaining portion of the sheet is advanced by the infeed conveyor. This speed differential creates a gap between the separated leading end portion and the remaining portion of the sheet so that the leading edge of the remaining portion of the sheet can again actuate the conveyor drive stopping limit switch when the new leading end of the sheet reaches the appropriate point on the conveying means.

Other objects and features of the invention will become apparent by reference to the following specification and to the drawings.

IN THE DRAWINGS

Figure 1:
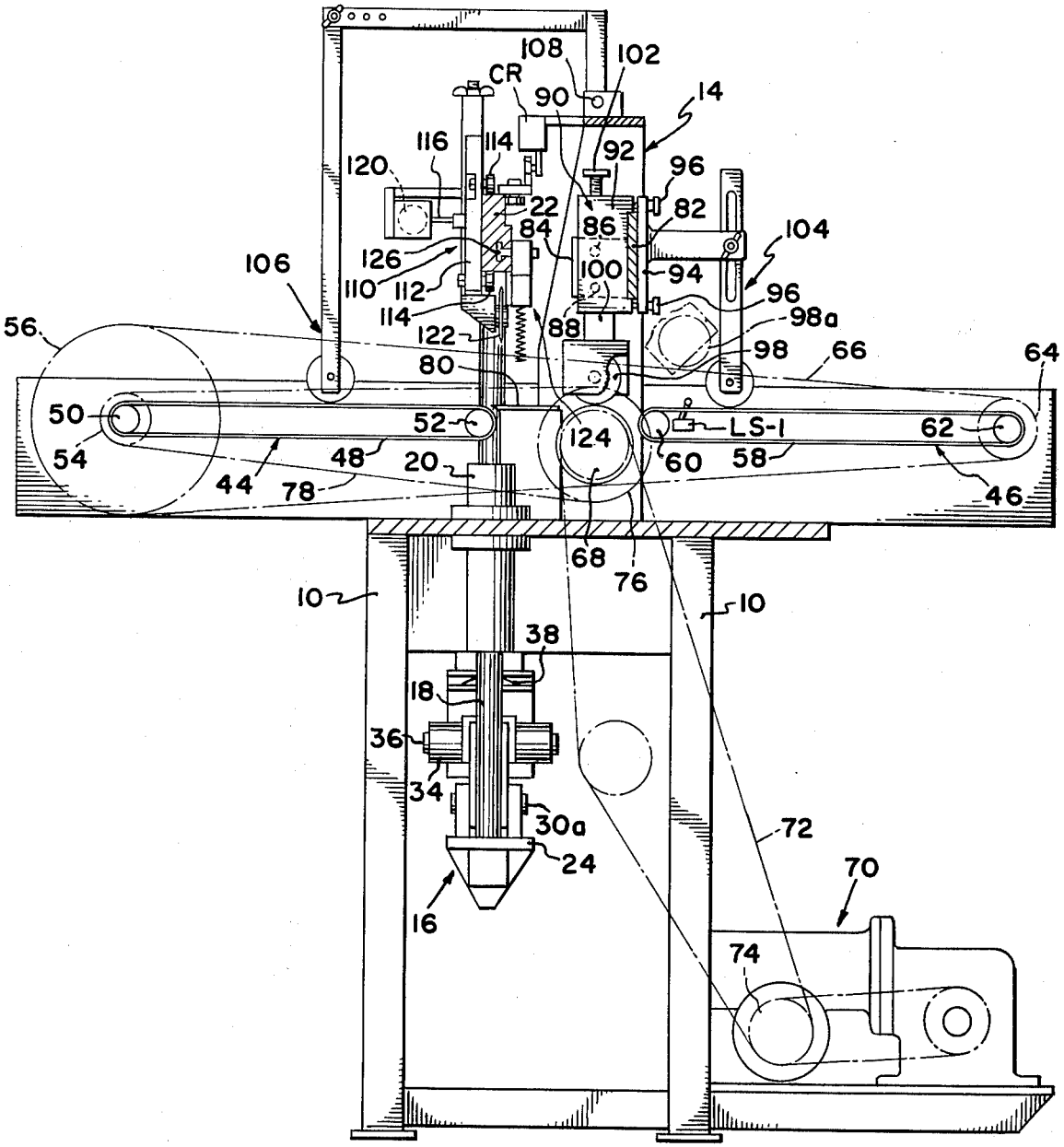
FIG. 1 is a side elevational view of an apparatus embodying the present invention, partially in section.

Apparatus embodying the present invention includes a fixed frame having a group of upstanding legs 10 which support a horizontally extending table-like conveyor frame designated generally 12 and a fixed upper frame portion designated generally 14. A vertically movable support frame designated generally 16 includes a pair of vertically extending rod members 18 slidably guided in bushings 20 mounted on table frame 12, the upper ends of vertical rods 18 being fixedly interconnected by a support bar 22, while the lower ends of rods 18 are rigidly interconnected by a crossbar member 24.

Movable support frame 16 (see FIG. 2) is coupled to table frame portion 12 of the fixed frame by two pivoted link assemblies 26, 28 and **26*a*, 28*a*, the links 26, 26*a* being pivotally coupled at one end to lower crossbar 24 as at 30, 30*a* and the links 28, 28*a* being pivotally coupled to table frame 12 as at 32, 32*a*. A rigid cross connecting link 34 is pivotally coupled at its opposite ends to pivots 36, 36*a* which also pivotally interconnect link 26 to link 28 and link 26*a* to link 28*a*, respectively. A differential pressure motor is employed to raise and lower movable support frame 16 and includes a cylinder 38 pivotally coupled to table frame 12 as at 40 and a piston rod 42 which is pivotally coupled at its outer end to the common pivot 36 which joins cross link 34 to links 26 and 28.**

Table frame portion 12 supports an infeed conveyor designated generally 44 and an outfeed conveyor designated generally 46. Infeed conveyor 44 includes a series of endless belts 48 trained around end rolls 50 and 52. End roll 50 of link feed conveyor 44 carries a small drive pulley 54 and a large drive pulley 56. Outfeed conveyor 46 likewise includes a series of endless belts 58 pivotally trained around end rolls 60 and 62, end roll 62 also carrying a drive pulley 64 which is driven by an endless belt 66 operatively trained around pulley 64 of feed conveyor 46 and large drive pulley 56 of infeed conveyor 44.

As best seen in FIG. 1, the adjacent end rolls 52 and 60 of infeed conveyor 44 and outfeed conveyor 46 are spaced from each other, and within this space a back-up roller 68 is mounted for location about an axis parallel to those of the end rolls of conveyors 44 and 46 with the upper surface of roll 68 being tangent to the upper conveying surfaces of the conveying belts of conveyors 44 and 46. A conveyor drive motor 70 is mounted upon the machine frame and is employed to simultaneously drive both of the conveyors 44 and 46 by means of a drive belt 72 operatively trained above an output pulley 74 of motor 70 and back-up roll 68. Rotation of back-up roll 68 is transmitted from a drive pulley 76 carried by the back-up roll to end roll 50 of conveyor 44 by means of an endless belt 78 operatively trained around pulley 76 on back-up roll 68 and pulley 54 which is carried by end roll 50 of conveyor 44. Rotation of end roll 50 is in turn transmitted to end roll 62 of conveyor 46 via drive pulley 56 on end roll 50 and endless belt 66 which is trained about pulley 64 on end roll 62. The ratio of the diameters of pulleys 56 and 64 is such that belts 58 of outfeed conveyor 46 are driven at a substantially higher conveying speed as compared to the conveying speed of belts 48 of infeed conveyor 44. Preferably, belts 58, feed conveyor 46 are driven about three times as fast as belts 48 of infeed conveyor 44.

Also located between the adjacent ends of conveyors 44 and 46 is a fixed horizontal plate or anvil 80 which extends transversely across the conveyors and has an upper surface which is coplanar with the conveying surfaces of infeed conveyor 44 and outfeed conveyor 46.

A crossbar member 82 having forwardly projecting end portions 84 is mounted upon upper frame member 14 by means of pivot pins 86 which pass through end portions 84 to support cross member 82 for pivotal movement about a horizontal axis extending transversely of the machine. Locking pins 88 pass through aligned bores in end portions 84 of cross member 82 and in adjacent portions of upper frame section 14 to normally lock cross member 82 in the position shown in full line in FIG. 1.

Cross member 82 serves as a support rail upon which a plurality of slitter assemblies 90 are mounted. Each slitter assembly 90 includes a housing 92 and a clamp plate 94 attached to housing 90 by clamping screws 96 which are employed to releasably clamp the assembly 90 to a selected transverse position upon cross member 82.

A slitter wheel 98 is rotatably mounted at the lower end of a strut 100 which is received in housing 92 for vertical movement. An adjustment screw 102 is employed to vertically position the strut 100 within housing 92, adjustment screw 102 being normally adjusted so that the slitter wheel 98 of its assembly 90 bears against back-up roll 68 with a slight degree of pressure. Because of the normal pressure setting urging slitter wheels 98 against back-up roll 68, when it is desired to shift the slitter wheels along cross member 82 to a new position of adjustment, the locking pins 88 are retracted from end portions 84 of cross member 82 to enable the cross member, together with the slitter assemblies 90 to be swung about pivots 86 in a counterclockwise direction as viewed in FIG. 1 to locate the slitter wheels in the broken line position illustrated at 98*a* in FIG. 1. With the assembly in this line of position, the slitter wheels are disengaged from back-up roll 68 and the desired adjustment of the assemblies 90 transversely of the machine can be made by loosening the clamping screws 96, shifting the assemblies 90 to the new position and retightening screws 96. Cross member 82 is then restored to the full line position shown in FIG. 1 and locking pins 88 reinserted to lock the assembly in position.

Slitter wheels 98 function to cut parallel longitudinal slits in a sheet of material as it is fed along the infeed and outfeed conveyors of the machine. Hold down roll assemblies designated generally 104 are mounted on each clamping plate 94 to hold the sheet down on the conveying belt of outfeed conveyor 46 at either side of the longitudinal slit. A second series of hold down rolls designated generally 106 are pivotally supported from the top of upper frame section 14 as by a pivot shaft 108.

A transverse slitter assembly designated generally 110 is mounted upon crossbar 22 of movable support frame 16. Carriage 110 includes a housing 112 supported upon crossbar 22 as by rollers 114. Carriage 110 is driven in movement back and forth along crossbar 22 by a carriage drive which includes an endless cable 116 trained around a pair of pulleys 118 located at opposite sides of movable support frame 16. A reversible pneumatic reciprocating piston drive motor such as 120 is operatively connected to drive the cable to convey carriage 110 from one side of movable support frame 16 to the other.

Carriage 110 carries at its lower end a rotatably mounted transverse slitter wheel 122 which, when the support frame 16 is in its lowered position, rests on anvil 80 and is operable, upon movement along the crossbar 22 to form a transverse slit in a sheet of material resting upon end wheel 80.

Figure 2:
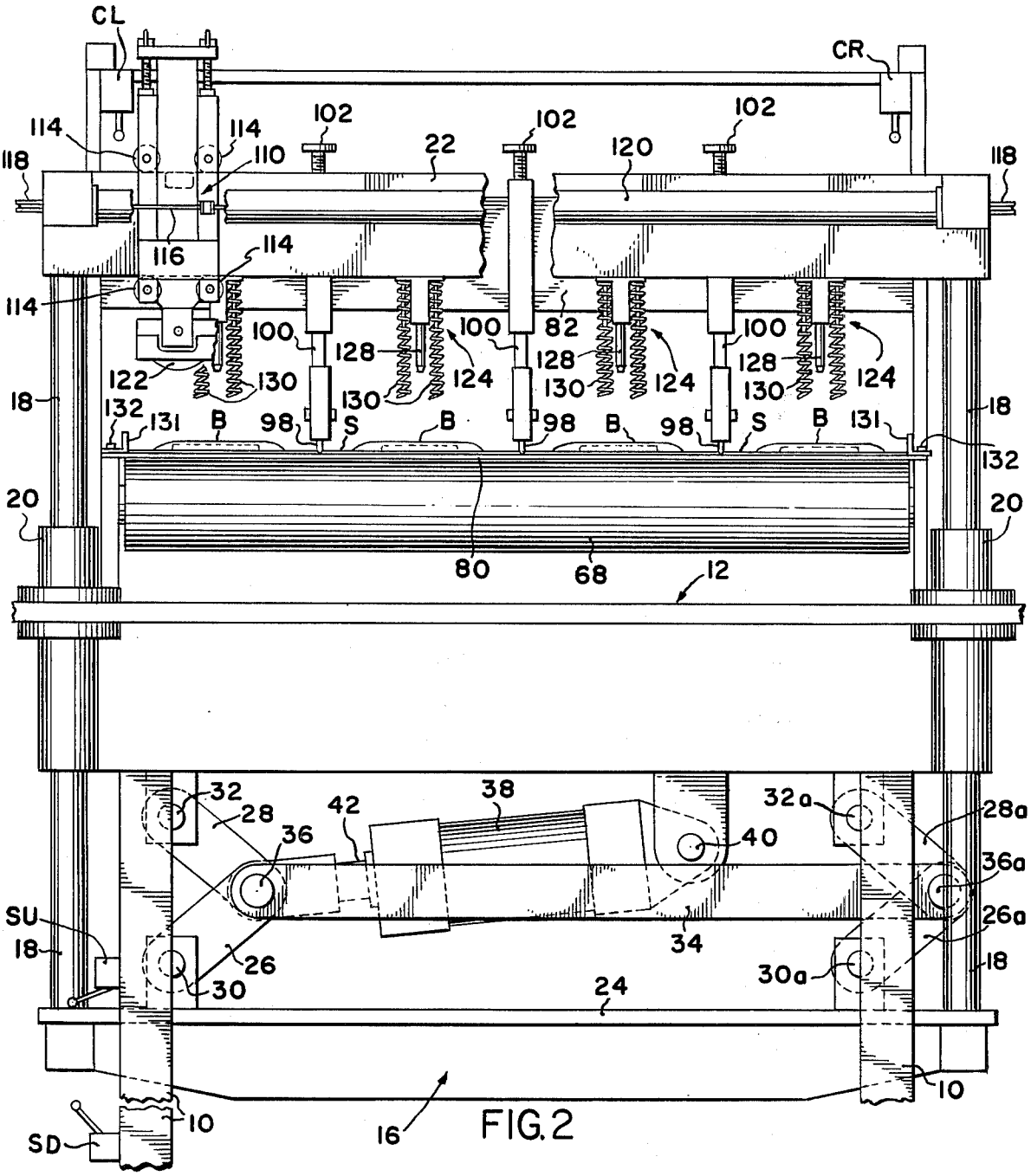
FIG. 2 is an end view of the apparatus of FIG. 1, looking into the apparatus from the infeed end, with certain parts broken away.

A plurality of punch assemblies designated generally 124 are also mounted on crossbar 22 for adjustment transversely of the apparatus as by a T-slot connection 126 (FIG. 1). The punch assemblies 124 can be clamped in selected positions along the T-slot by a suitable clamp screw of well known construction. As best seen in FIG. 2, each punch assembly 124 includes a downwardly projecting punch 128. Compression springs 130 on either side of each punch 128 serve to cushion the downward movement of the movable support assembly 16.

Figure 3:
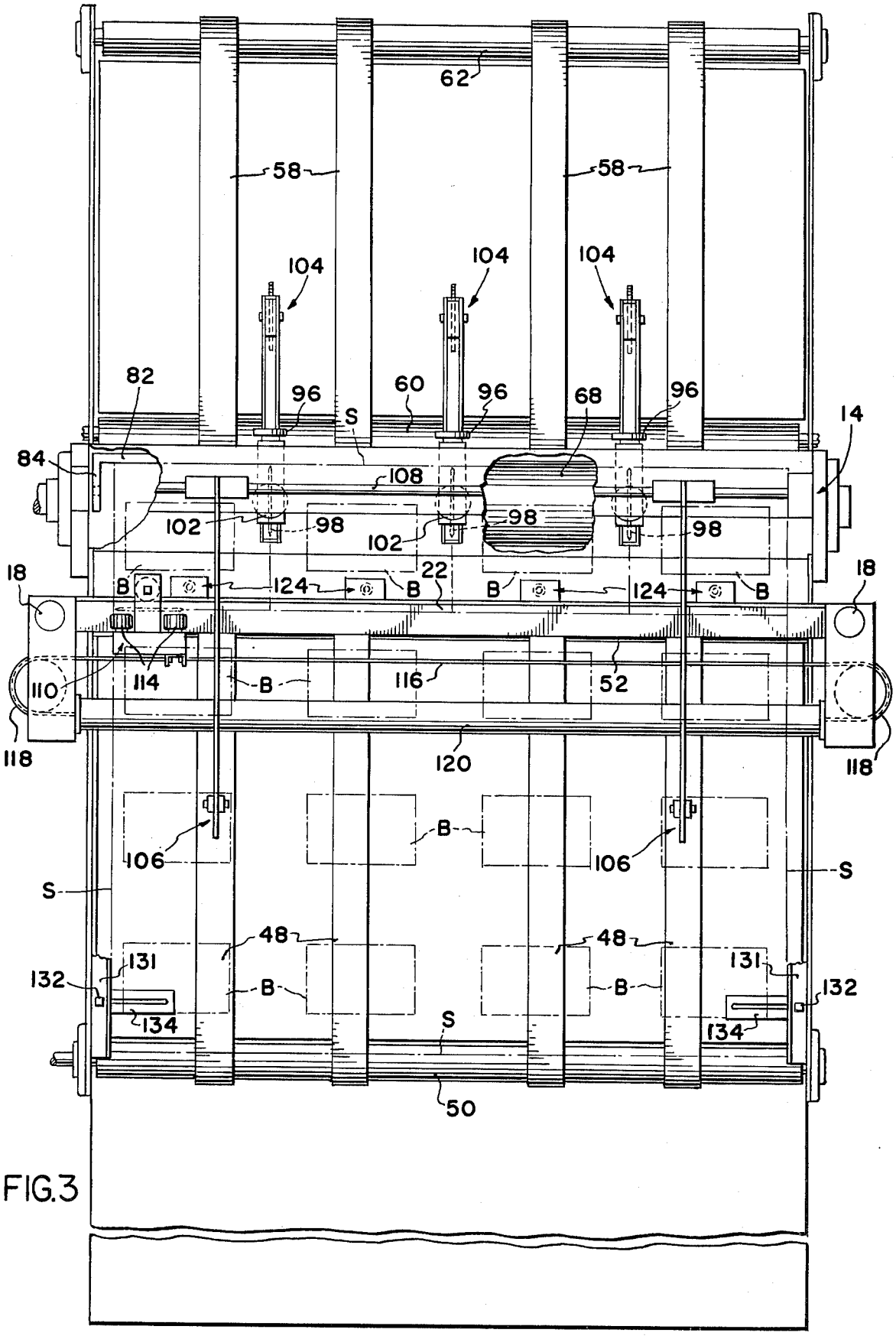
FIG. 3 is a top plan view of the apparatus.

To guide a sheet being fed through the apparatus, transversely adjustable guide rails of any suitable type are provided. Guide rails may, for example, consist simply of opposed longitudinally extending angle irons 131 locked in selected positions of adjustment by means of clamping bolts 132 which cooperate with suitable support such as 134 (FIG. 3). Guide rails 131 extend substantially the entire length of the conveyor to engage the opposed longitudinal sides of the sheet as it is being fed through the system to locate the sheet relative to the cutters.

Figure 4:
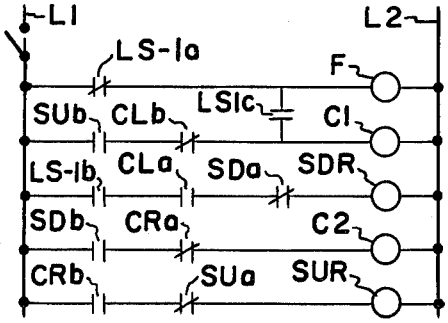
FIG. 4 is a schematic diagram of an electrical control circuit for controlling operation of the apparatus.

Control of the apparatus in operation is performed by an electrical control circuit schematically illustrated in FIG. 4. The sensing elements of the control circuit include five limit switches. Limit switch LS1 (FIG. 1) is located near the upstream end of outfeed conveyor 46 and is positioned with its striker normally disposed to project upwardly into the path to travel of a sheet being advanced along the conveyor. When the leading end of the sheet being advanced along the conveyor reaches the striker of limit switch LS1, the striker is depressed to initiate a control function to be described in great detail below.

Referring now to FIG. 2, two limit switches SU and SD are mounted on the machine frame to be respectively actuated when movable support 16 is in its upper position (SU) or when the support is down (SD). Two carriage position detecting limit switches CL and CR are mounted upon movable support frame 16 to be respectively engaged when carriage 110 is at the left or right hand end of its travel as viewed in FIG. 2.

In the schematic diagram of the control circuit of FIG. 4, drive motor 70 for infeed conveyor 44 and outfeed conveyor 46 is symbolically represented at F, while drive motor 120, which drives carriage 110 back and forth along crossbar 22 is represented by control elements C1 and C2, C1, when energized, causing the carriage motor to drive in one direction and control element C2, when energized, causing the carriage drive motor to drive in the opposite direction. Solenoids SDR and SUR represent solenoids controlling a conventional four-way reversing valve for controlling the flow of operating fluid to and from the cylinder 38 of the hydraulic motor which raises or lowers movable support frame 16.

OPERATION

In a typical operation, the apparatus described above may be employed to slit a sheet of paperboard S (FIG. 2) having articles secured to the sheet by plastic blisters B with four articles being aligned in a row transversely of the sheet and the sheet having a series of such rows one behind the other. The apparatus is operated to longitudinally slit the sheet between the articles in each row and to transversely slit the sheet between each adjacent row as the sheet is intermittently advanced along the apparatus from infeed conveyor 44 to outfeed conveyor 46.

Initially guide rails 130 are adjusted to the desired position to guide the sheet in straight line movement along the conveyors, the individual longitudinal slitter assemblies 90 are transversely adjusted on cross member 82 so that the slitter wheels 98 will be located in the desired position as shown in FIG. 2 and punch assemblies 124 are likewise transversely positioned on crossbar 22. The length of the sheet between transverse cuts is determined by the distance between the striker of LS1 and the path of movement of transverse slitter wheel 122.

At the beginning of a slitting operation, movable support 16 is located in its upper position, as shown in FIG. 2, and the transverse slitter carriage is located in its extreme left hand position, which is somewhat to the left of the position shown in FIG. 2, in which slitter wheel 122 is located somewhat to the left of the left hand edge of sheet S.

The leading end of the sheet to be slit is then placed on infeed conveyor 44 and feed motor 70 is energized by closing the on/off switch of the control circuit of FIG. 4 to energize the feed motor by completing a circuit through feed motor F via the normally closed contacts LS1*a* of limit switch LS1, these contacts being closed at this time because the striker of limit switch LS1 (FIG. 1) is not engaged as yet by the leading end of the sheet. Energization of control element F causes feed motor 70 to drive both infeed conveyor 44 and outfeed conveyor 46, and this action advances the leading end of the sheet from left to right as viewed in FIG. 1. As the leading end of the sheet passes beyond end roll 52 of infeed conveyor 44, it moves onto and across anvil 80 and thence into contact with back-up roller 68, at which time the slitting wheels 98 begin to longitudinally slit the sheet as the sheet is advanced past wheels 98 and back-up roll 68. The leading end of the sheet continues to advance and moves onto outfeed conveyor 46.

Although outfeed conveyor 46 is driven at a faster conveying speed than is infeed conveyor 44, only a small portion of the sheet is engaged by outfeed conveyor 46 at this time, while a relatively large portion of the sheet is still engaged with infeed conveyor 44. While some acceleration of the sheet may begin to occur, it is not substantial.

As the leading end of the sheet moves onto outfeed conveyor 46, its leading end moves into contact with the striker of limit switch LS1 to depress the striker, thus opening normally closed contacts LS1*a* to deenergize control element F and thus stop further driving movement of feed motor 70 and infeed conveyors 44 and 46.

When the striker of limit switch LS1 is depressed, it closes a set of normally open contacts LS1*b.* At this time, carriage 110 is at its extreme left hand end of movement and the striker of limit switch CL is engaged by the carriage to thus close normally open contacts CL*a.* Thus, the closure of contacts LS1*b* causes the energization of the support down relay SDR via contacts LS1*b* and CL*a* (closed at this time because the carriage is at its left hand movement,) and normally closed contacts FD*a.* Energization of relay SDR causes piston rod 42 to stroke outwardly from cylinder 38 thus driving movable support frame 16 from its upper limit of movement to its lower limit of movement. When support frame 16 arrives at its lower limit of travel, limit switch SD is actuated to open normally closed contacts SD*a* to deenergize relay SDR thus stopping further driving movement of piston rod 42.

Simultaneously with the opening of contacts SD*a,* contacts SD*b* are closed and a circuit is completed to carriage drive control relay C2 via the normally closed contacts CR*a.* This energizes motor 120 in a direction causing carriage 110 to be conveyed from left to right as viewed in FIG. 2. Because the support frame 16 is in its lowered position at this time slitter wheel 122 is in operative engagement with anvil 80 and as carriage 114 is driven from left to right as viewed in FIG. 2, slitter wheel 122 transversely slits the sheet S.

When carriage 110 arrives at its right hand limit of movement, the striker of limit switch CR is depressed by the carriage to open contacts CR*a,* thus deenergizing the carriage drive motor and simultaneously closing normally open contacts CR*b.* Closure of contacts CR*b* energizes relay SUR via normally closed contacts SU*a* to reverse the hydraulic connections to cylinder 32 to retract piston rod 42, thereby returning movable support frame 16 to its upper position. When support frame 16 arrives at its upper position, limit switch SU is engaged to open the normally closed contacts SU*a* thereby deenergizing relay SUR.

When movable support 16 arrives at its upper position, the striker of limit switch SU is depressed to close normally open contacts SU*b.* Because the carriage 110 is at this time away from its home position or extreme left hand limit of travel, limit switch contacts CL*b* are closed and thus the carriage return relay C1 is energized to cause motor 120 to drive in a direction returning the carriage to its left hand limit of travel. At the same time, the feed motor relay F is energized via the normal open contacts LS1*c* which are closed at this time because the striker of limit switch LS1 is depressed by the leading end of the sheet.

When relay F is energized, the conveyor drive motor 70 is energized to simultaneously drive both the infeed and outfeed conveyors. Because the outfeed conveyor is driven at a speed greater than that of the infeed conveyor, the leading row of packages, which have been separated from the main body of the sheet by the previous operation of the transverse slitter unit 110, move forwardly faster than does that portion of the sheet which is being advanced by infeed conveyor 44. Thus, a gap is developed between the transversely severed forward row of packages and the remaining or next row of packages so that the striker of limit switch LS1 can elevate to be in its detecting position when the newly formed leading edge of the sheet arrives at the limit switch. When the striker of limit switch LS*a* raises contacts LS1*c* open, however, contacts LS1*a* simultaneously close so that feed motor relay F remains energized. This latter action occurs before the carriage 110 arrives at its home position at the left hand end of its limit of travel at which time contacts CL*b* open to deenergize the carriage return relay C1.

The cycle described above is then repeated.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

What is claimed is:

1. Apparatus for longitudinally and transversely slitting a sheet of paperboard or like material to form a plurality of individual rectangular cards comprising feed means for feeding an elongate sheet of material in a direction at a first speed along a first upstream section and at a second speed higher than said first speed on a second downstream section, a plurality of transversely spaced first cutter means operatively associated with said feed means at a location between said first and second sections for cutting spaced parallel longitudinal slits through said sheet as said sheet is advanced by said feed means, transversely extending support means overlying said feed means between said first and second sections and supported for vertical movement between a normally maintained upper position and an actuated lower position, second cutter means mounted on said support means for movement transversely of said feed means between a normally maintained first end limit at a side edge of a sheet on said feed means and an opposite end limit wherein said second cutter is located at the opposite side edge of a sheet in said feed means, said second cutter means being located clear of said sheet on said feed means when said support means is in said upper position and being located in cutting relationship with said sheet on said feed means when said support means is in said lower position, first reversible drive means for shifting said support means between upper and said lower position, second reversible drive means for driving said second cutter means between its first and second end limits of movement, and control means operable upon the advancement by said feed means of the leading end of the sheet to a preselected position on said feed means for sequentially:

a. stopping said feed means,
b. actuating said first drive means to drive said support means to its lower position,
c. actuating said second drive means to drive said second cutter means from said first end limit to said second end limit to separate the leading end portion of said sheet from said sheet,
d. actuating said first drive means to raise said support means,
e. simultaneously starting said feed means to advance the separated leading end portion of said sheet along said second section away from the remainder of said sheet, and
f. actuating said second drive means to return said second cutter means to its first end limit.

2. Apparatus as defined in claim 1 further comprising punch means mounted on said support means for punching holes in said sheet upon movement of said support means for punching holes in said sheet upon movement of said support means from its upper to its lower position.

* * * * *